US010071547B2

(12) United States Patent
Paul

(10) Patent No.: US 10,071,547 B2
(45) Date of Patent: Sep. 11, 2018

(54) TYPESETTING GRID SYSTEM

(71) Applicant: Fitz and Startz, LLC, San Diego, CA (US)

(72) Inventor: Tobianne Paul, San Diego, CA (US)

( * ) Notice: Subject to any disclaimer, the term of this patent is extended or adjusted under 35 U.S.C. 154(b) by 0 days.

(21) Appl. No.: 15/004,824

(22) Filed: Jan. 22, 2016

(65) Prior Publication Data

US 2016/0221322 A1 Aug. 4, 2016

Related U.S. Application Data

(60) Provisional application No. 62/107,221, filed on Jan. 23, 2015.

(51) Int. Cl.

| | |
|---|---|
| ***B41K 1/08*** | (2006.01) |
| ***B41B 1/02*** | (2006.01) |
| ***B41B 1/22*** | (2006.01) |
| ***B44B 5/00*** | (2006.01) |

(52) U.S. Cl.
CPC ..... *B41B 1/02* (2013.01); *B41B 1/22* (2013.01); *B41K 1/08* (2013.01); *B44B 5/0085* (2013.01)

(58) Field of Classification Search
CPC .... B41B 3/04; B41B 1/02; B41K 1/08; B41K 1/20; B41F 1/02; B44B 5/022; B44B 5/02; B44B 5/0085
USPC ..... 276/40, 38, 14; 101/398
See application file for complete search history.

(56) References Cited

U.S. PATENT DOCUMENTS

| | | | | |
|---|---|---|---|---|
| 7,738 | A * | 10/1850 | Beniowski | B41B 1/02 101/398 |
| 921,974 | A | 5/1909 | Ginsburg | |
| 1,964,236 | A | 6/1934 | Welch | |
| 3,259,063 | A * | 7/1966 | Rothman | B41K 1/08 101/333 |
| 5,313,885 | A | 5/1994 | Winston | |
| 6,708,614 | B2 * | 3/2004 | Lookholder | B41D 7/00 101/401.1 |
| 8,146,494 | B2 | 4/2012 | Hutchison et al. | |
| 8,393,266 | B2 | 3/2013 | Rasmussen et al. | |
| 8,522,680 | B2 | 9/2013 | Angevine | |
| 8,807,028 | B2 | 8/2014 | Hutchison et al. | |
| 2012/0192733 | A1 | 8/2012 | Angevine | |

* cited by examiner

*Primary Examiner* — Blake A Tankersley
(74) *Attorney, Agent, or Firm* — Bay Area Technology Law Group PC

(57) ABSTRACT

A three dimensional typeset apparatus is disclosed having a grid with a plurality of apertures for accommodating a plurality of sorts. The grid can accommodate sorts having a variety of dimensions and shapes. Each of the sorts has two sides, one side with a raised print surface and the opposite side which is a mirror image of the print side which enables the user to see how the layout looks when it prints. The sorts can print a single character or can print enlarged continuing images. A variety of attachments to secure each sort within the grid is disclosed.

6 Claims, 13 Drawing Sheets

TYPESETTING GRID SYSTEM

RELATED APPLICATION

This utility application claims priority from Provisional Patent Application, filed on Jan. 23, 2015 by the same inventor, entitled "Typeset Grid System", application No. 62107221.

TECHNICAL FIELD

The subject invention relates to an improved typesetting apparatus and method.

BACKGROUND OF THE INVENTION

In typesetting by hand compositing, a sort is a piece of type representing a particular letter or symbol assembled with other sorts bearing additional letters or lines of type to make up a form from which a page is printed. Lead pieces or strips provide necessary spacing between sorts.

Current chase lock typesetting or letterpress achieve and maintain alignment using quoins, which are wedges or expanding mechanical devices used for locking a letterpress form into a chase. Alternatively, a completed unalterable "work-up" is fitted to a block for use. Such devices require multiple components to create a work-up, or limit the work-up to a single set-up. This requires a large number of pieces for which an operator must have an ability to effectively employ them. This requires much practice to acquire the required special skills to do such printing, making manual relief printing less accessible to the lay person and hobbyist.

Various devices are available to typesetting printing. But all have their limitations. For example, typical typesetting printing devices require the printing type or sorts to be assembled by the user using the actual printing face, which is a mirror image of what is actually printed.

It is therefore an object of the invention to provide a typesetting device which allows a user to easily set the sorts or type without the need of the use of mirrors or without viewing a mirror image of the image to be printed.

Another object of the invention to secure sorts within a grid which does not require the use of spacers or quoins.

It is therefore an object of the invention to provide a typesetting apparatus and method that allows the user to see the image of what actually will be printed as the printing sorts are arranged on a grid, rather than a mirror image.

These and further objects will be readily apparent when considering the following disclosure

SUMMARY OF THE INVENTION

In accordance with the invention a three dimensional grid system is provided of various size or shape, used to align and secure sorts with print or emboss shapes including but not limited to symbols, letters, geometric pattern, or other images for use in moveable-type manual relief printing, ink or material transfer printing, or embossing. Sorts are secured within the grid by various mechanical attachments including snaps, spindles, interlocking compatible male and female components or designs in which one component secures the other(s), and including encasement or entrapment where a plate, panel or other component effectively holds the sorts in place.

In accordance with the invention, the grid is in the form of a plate, block or platen with a series of apertures or protrusions, fixed or variable in size and arrangement, capable of fitting on or through a device intended to apply pressure such as a press, printing press, or die cutting machine.

As used herein sorts may be blocks, letter pegs or other pins, stakes, sticks or log shapes with a raised character on one side and the other side is capable of fitting into or onto the grid plate. Optional components include blanks or sorts without a raised face intended as a space or place holder within a form.

The grid allows sorts to be loaded with the non-raised face out so characters appear to the user as they will print. In one embodiment the sorts are provided with fastening devices so that they can be locked in place in the grid. In another embodiment, a plate, preferably transparent, can be added on top of the sorts to secure them into place once they are composed for printing. In both embodiments the sorts are secured for the purpose of printing or other uses. In another embodiment the sorts are provided with holes through them and pins or mandrels pass through conduits in the grid and through the sorts to secure the sorts within the grid.

In another embodiment sorts are secured into or onto the grid via male and female compatible snap on components. Secured sorts on the grid create a "form" that is mounted onto or in a press, inked and impressed against paper to create a relief printed image.

DETAILED DESCRIPTION OF THE INVENTION

Figure 1:
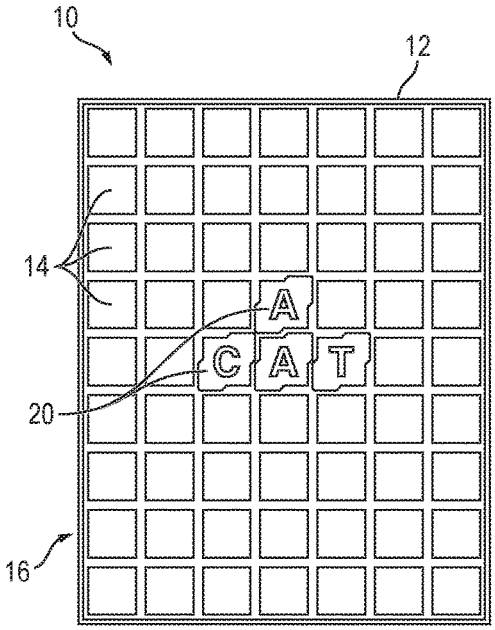
FIG. 1 is a top view of a typeset device of one embodiment of the present invention.

Novel features which are characteristic of the invention, as to organization and method of operation, together with further objects and advantages thereof will be better understood from the following description considered in connection with the accompanying drawings, in which preferred embodiments of the invention are illustrated by way of example. It is to be expressly understood, however, that the drawings are for illustration description only and are not intended as definitions of the limits of the invention. The various features of novelty which characterize the invention are recited with particularity in the claims.

There has been broadly outlined more important features of the invention in the summary above and in order that the detailed description which follows may be better understood, and in order that the present contribution to the art may be appreciated.

There are, of course, additional features of the invention that will be described hereinafter and which will form additional subject matter of the claims appended hereto. Those skilled in the art will appreciate that the conception upon which this disclosure is based readily may be utilized as a basis for the designing of other structures, methods and systems for carrying out the several purposes of the present invention. It is important therefore, that claims be regarded as including such equivalent constructions insofar as they do not depart from the spirit and scope of the present invention.

Certain terminology and the derivations thereof may be used in the following description for convenience and reference only, and will not be limiting. For example, words such as "upward," "downward," "left," and "right" refer to directions in the drawings to which reference is made unless otherwise stated. Similar words such as "inward" and "outward" refer to directions toward and away from, respectively, the geometric center of a device or area and designated parts thereof. Reference in the singular tense include the plural and vice versa, unless otherwise noted.

Figure 2:
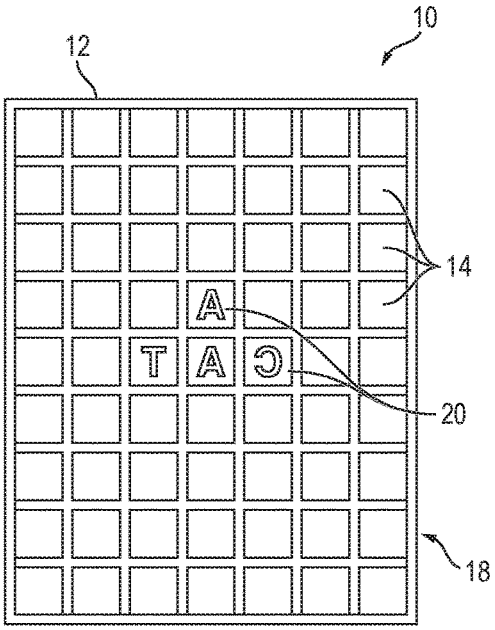
FIG. 2 is a bottom view of the typeset device of FIG. 1.

FIGS. 1, 2, 3 and 4 are top views of typeset devices 10, each comprising a structured grid 12 having a plurality of apertures 14 which extend from the top or layout side 16 to the bottom or print side 18. The sorts 20 shown in the grid 12 are letter pegs or sorts which extend through the apertures 14 which create a full word when mounted in the correct sequence. In FIGS. 1 and 2 the three sorts 20 have fonts which form the words "A CAT" and in FIGS. 3 and 4 form the words A THANKS! As explained later in greater detail the sort THANKS! is a continuing sort.

Figure 3:
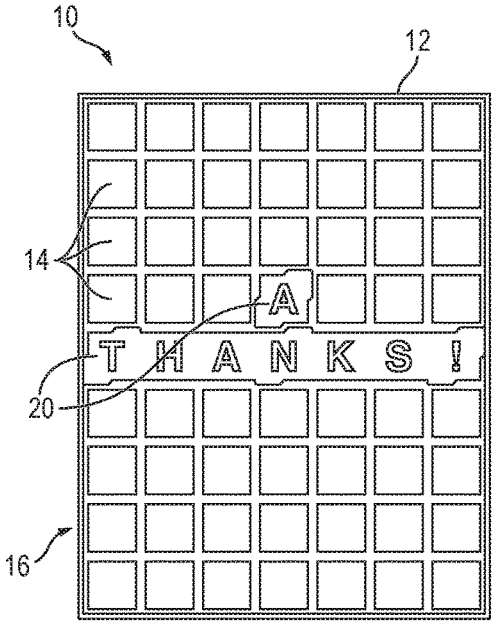
FIG. 3 is a top view of a typeset device of another embodiment of the present invention.
Figure 4:
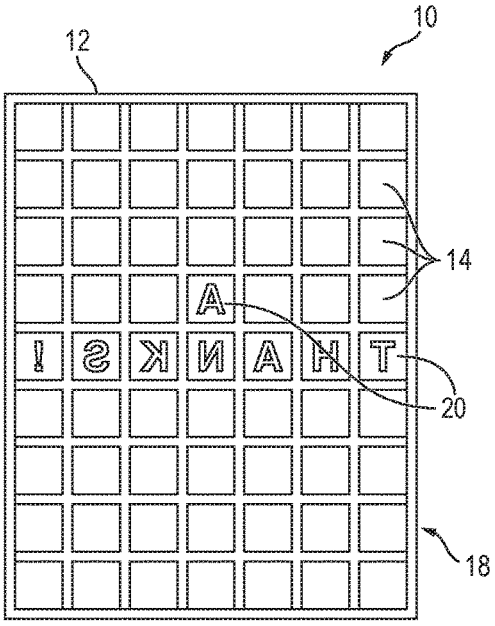
FIG. 4 is a bottom view of the typeset device of FIG. 3.

In FIGS. 1 and 3, the fonts on the pegs 20 are oriented normally on the layout side as assembled by the user, FIGS. 1 and 3, and as mirror images in FIGS. 2 and 4, of the print side. "Mirror image" as used herein can also be synonymous with the terms "backward image", "reverse image" and "inverse image" on the print side, FIGS. 2 and 4. Sorts 20 can be any block or peg with a raised image used individually, or in any combination to create a pattern, text or other graphic effect.

The grid layouts in FIGS. 1-4 may typically be for a 4"×6" typeset grid. It should be understood that this represents the grid concept for illustrative purposes, and other size options including 3"×5", 2"×3", 8.5"×11" or non-quadrilateral shapes such as circles, triangles and ovals may be used as well. A wide variety of font size options and grid spacing can be accommodated with the same functionality.

With a structured grid 12 fewer pieces are required and the process to align and secure sorts 20 is simplified. The time and skill necessary to complete and achieve the desired printed effect is greatly reduced. The grid plate 20 can be milled, carved, molded or forged from a variety of materials including wood, metals, plastics, stone or composite materials.

In FIGS. 1-4 the sorts 20 shown in the grid 12 is a word peg which displays a complete word or phrase. The word peg font is oriented as it would normally be read on the layout side by the user, FIGS. 1 and 3, and backwards or a mirror image to that for printing as it is read on the print side, FIGS. 2 and 4. A combination of letter and word pegs is used to create a desired layout effect.

Figure 5:
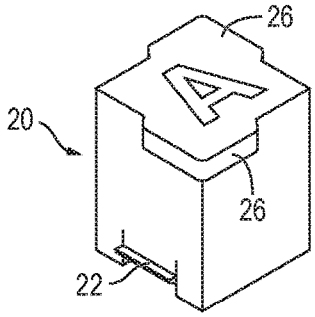
FIG. 5 is a perspective view of a sort with the image to be printed oriented to the user as it will appear on a print.
Figure 6:
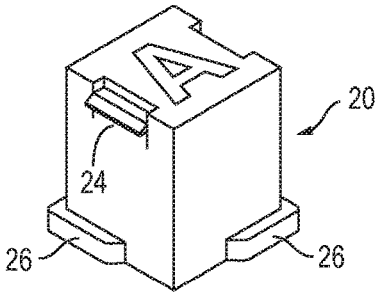
FIG. 6 is a perspective view of the bottom of the sort of FIG. 5 showing the raised print image which is a mirror image of that shown in FIG. 5.
Figure 7:
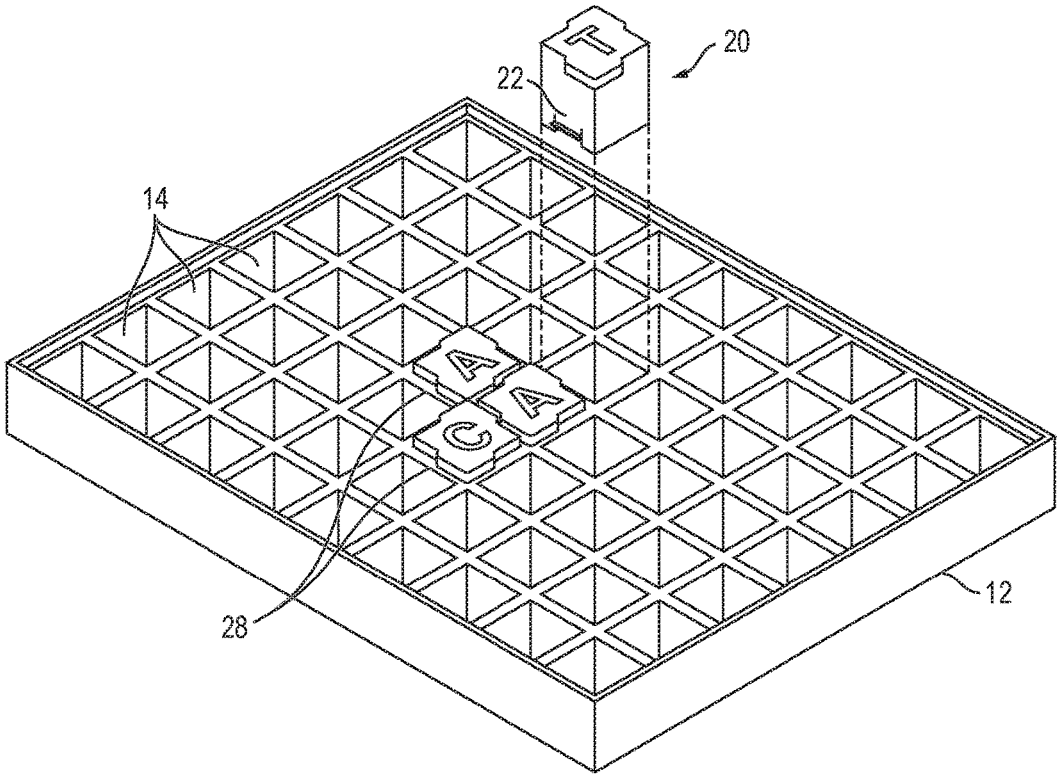
FIG. 7 is a perspective view illustrating how the sort of FIG. 5 is inserted into a grid by a user to format the print layout.

Referring to FIGS. 5 and 6, a sort 20 in the shape of a block or peg snap, locks or otherwise secures it onto or into the grid 12 as shown in FIG. 7. One side of the peg has an image of the character or form as it will be viewed by the user, as shown in FIG. 5. Another side of the peg has a raised image of the character as it will print which protrudes beyond the grid when secured, as shown in FIG. 6.

Sorts 20 are mounted with dual snaps 22 and 24 into the typeset grid base 20. The layout side of the grid allows the user to assemble each sort 20 into the pattern of sorts as desired to appear on the imprinted media, as shown in FIG. 7. The sorts are secured onto or into the grid plate 12 without the need for furniture, lead spacers or other spacers to achieve the desired alignment. Further securing elements like a chase lock are not necessary, since the sorts and grid male/female components secure them. Once the desired text, pattern or other imagery is achieved with the arrangement of sorts they are optionally inked and pressed onto a substrate capable of accepting ink or being relieved through pressure like paper, cardstock, metal, leather, wood using a press, printing press, die cut machine or other device intend to apply pressure.

There is no need to secure the sorts or form with adhesive, magnetic attraction, or other material to prevent the sort 20 arrangement from moving. Secured sorts on the grid create a "form" that is mounted onto or in a press, inked and impressed against paper to create a relief printed image.

Figure 8:
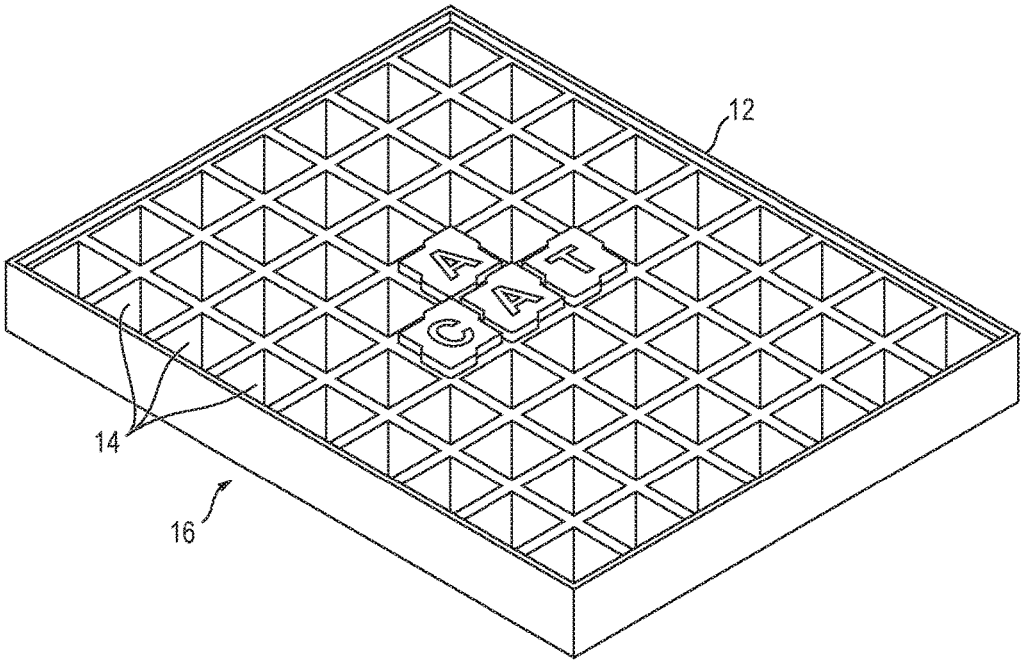
FIG. 8 is a perspective view of a grid illustrating the image to be printed to the user after the sorts have been inserted as illustrated in FIG. 7.
Figure 9:
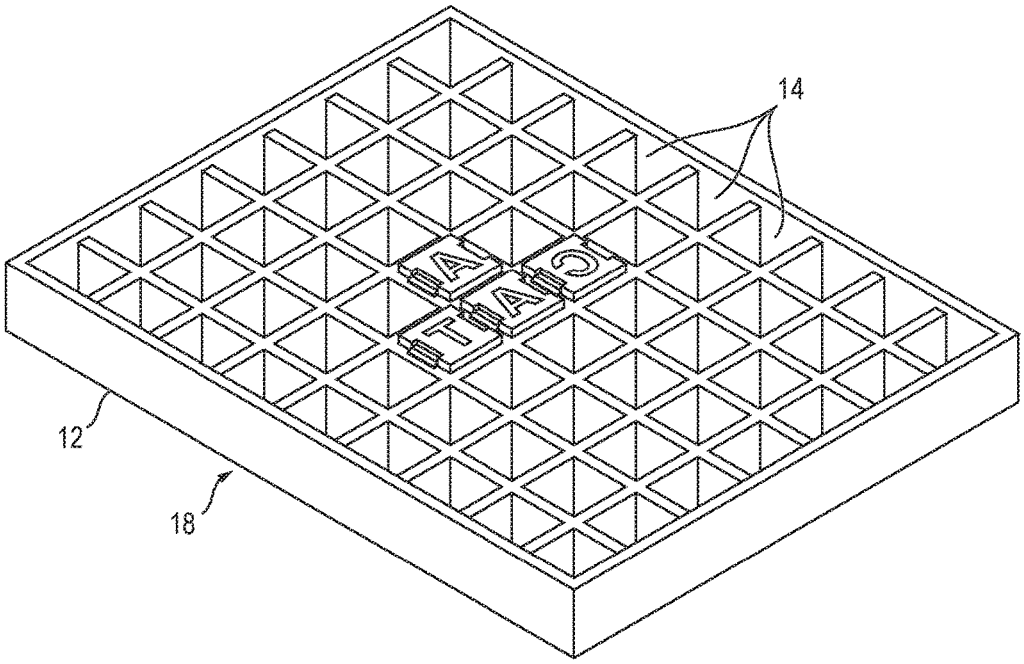
FIG. 9 illustrated the print side of the grid shown in FIG. 8.

As shown in FIG. 8, the open grid design and snap pegs allows for the desired layout to be set and viewed as it will appear printed. As shown in FIG. 9, the reverse view necessary for printing is on the opposite side of the grid. This eliminates the need for the user to set the desired pattern in mirror image. Sorts 20 are further held in place by a set of tabs 26 on the viewing side of sort 20 which engage the edges 28 of the apertures 14 formed in the grid 12.

Figure 10A:
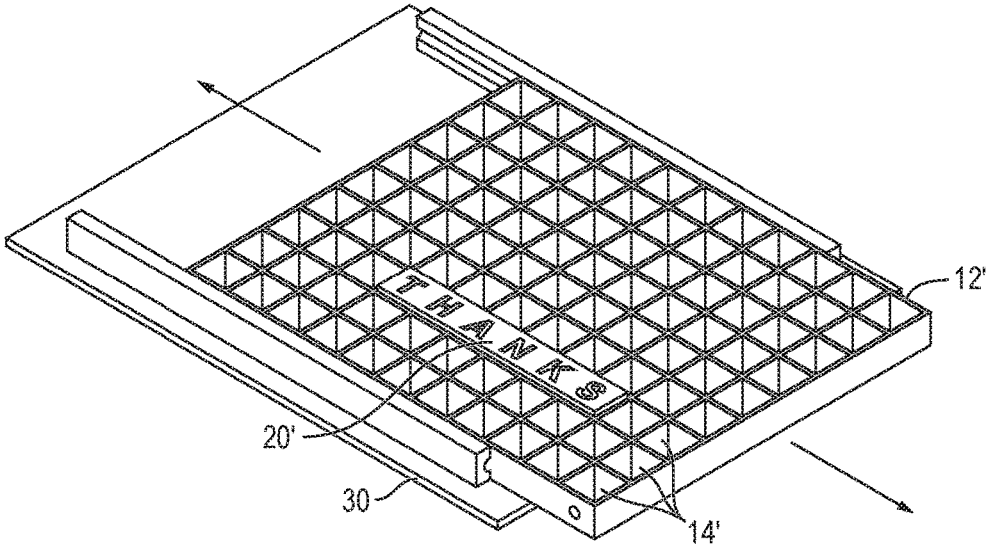
FIG. 10A illustrates another embodiment wherein a grid for holding a plurality of sorts is provided with an interlocking cover inserted over a plurality of sorts.
Figure 10B:
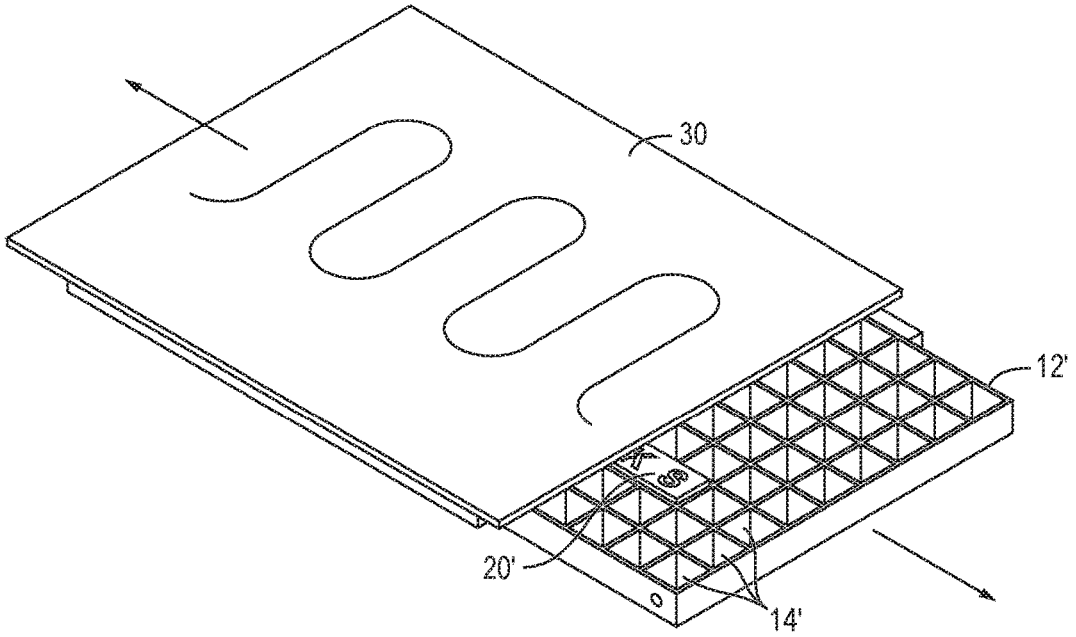
FIG. 10B illustrates the embodiment of FIG. 10A wherein the grid is inverted and the cover is put in place when in the grid is in the print position.

In accordance with another embodiment of the invention, a grid and cover can be used to secure sorts into place after layout is complete. Referring to FIGS. 10A and 10B, a grid 12' is provided with aperatures 14' in which the user inserts sorts 20' to form the print image the user desires. FIGS. 10A and 10B the view to the user how the print side will print the image. The grid 12' is removeably inserted within a cover 30. The cover 30 can be made of a transparent material to aid the user to see what the print format will be.

The grid 12' and cover 30 are interlocking or otherwise connected whereas the cover 30 is able to slide along the length of the grid 16' and away from the grid 12' to allow the cover to pivot and rest on either side of the grid as shown in FIG. 10A.

Figure 11A:
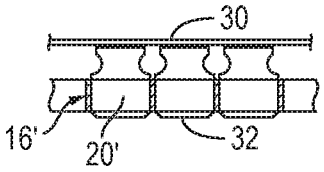
FIG. 11A shows a plurality of sorts with the user viewing sides in contact with the cover.
Figure 11B:
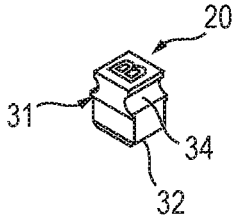
FIG. 11B shows an individual sort with a user gripping structure.
Figure 11C:
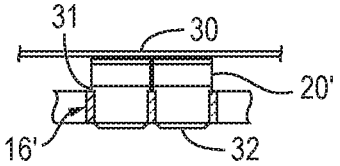
FIG. 11C illustrates a sort which engages and is held in place within the grid.
Figure 11D:
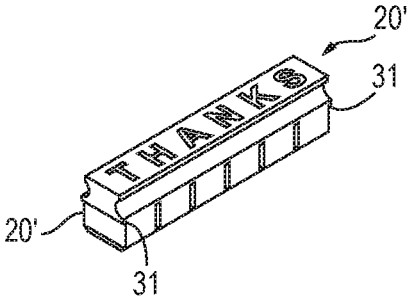
FIG. 11D illustrates a single sort having a continuing print image.

The layout side of sorts 20' are slightly larger in length or width or both than the grid aperture to form a rest ridge 31, allowing them to drop into the type setting grid and rest on the structure of the grid while the cover is pivoted in a position to expose the typesetting grid as shown in FIG. 11A. The rest ridge 31 is shown in FIGS. 11B and 11C. FIG. 11D shows a single sort 20' with continuing multiple print characters forming, in this case, the word THANKS. Sort 20' has a small ledge 31 to rest on the grid 12'.

FIG. 11B illustrates a single sort or character block. The letter B is the mirror or reversed image, seen by the user, of the character image of the raised print character 32 on the bottom of the sort 20'. A finger grip 34 is built into the sort for handling by the user.

Once a layout is complete, the cover 30 slides and pivots along the grid 12' to a position on the opposite side of the grid locking the sorts into place and exposing the printing side of the sorts as shown in FIGS. 10B and 11A. The sorts are easily freed from the grid after use by returning the cover to the printing side of the grid and either inverting the grid so that the sorts fall out or removing the sorts individually. This configuration makes breaking down the Typeset Grid setup faster, as each peg does not need to be unsnapped separately.

Figure 12:
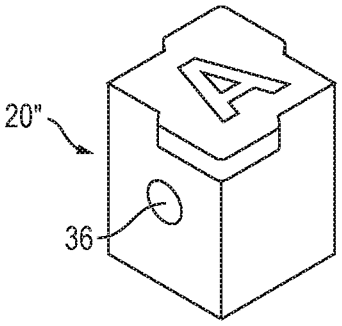
FIG. 12 shows an individual sort having a hole or conduit through it used in another embodiment of the present invention.
Figure 13:
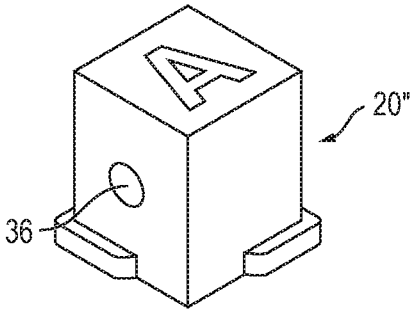
FIG. 13 illustrates the sort of FIG. 13 but inverted showing the print side of the sort.

FIGS. 12 and 13 illustrate another embodiment of the invention. Shown is a perspective view of a sort 20" which is an alternative to snapped sorts or pegs. FIG. 12 illustrates sort 20" with the view of the print image seen by the user and FIG. 13 illustrates the opposite side of the sort 20" of FIG. 12, showing the mirror image and the raised print surface.

Figure 14A:
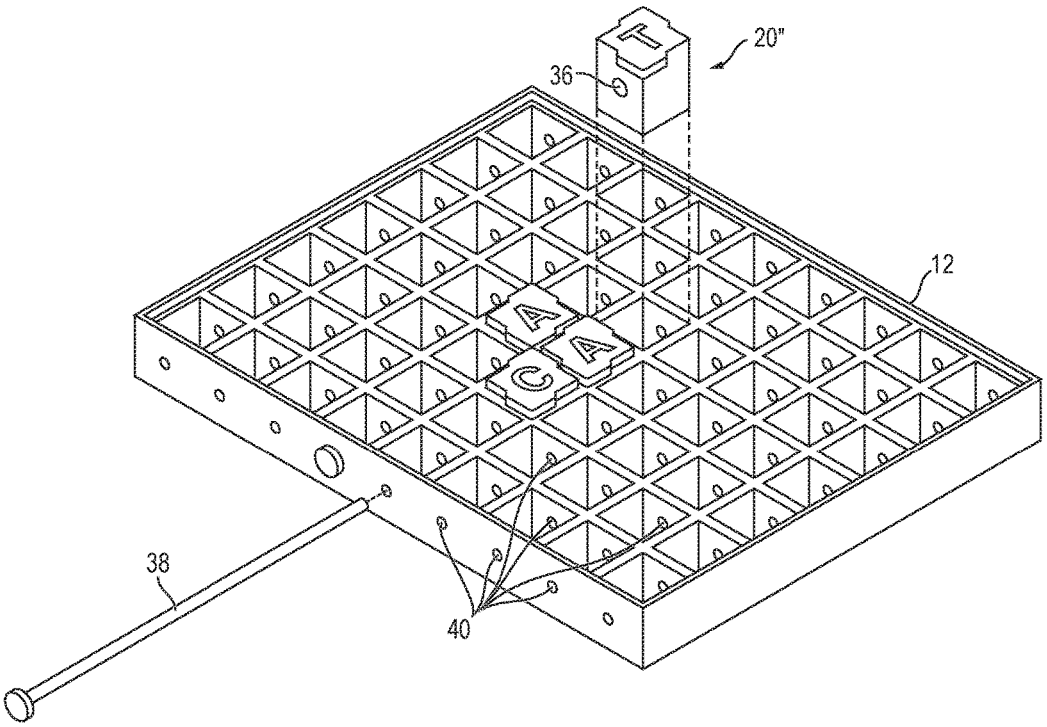
FIG. 14A illustrates another embodiment of the invention wherein a sort illustrated in FIGS. 12 and 13 is secured within a grid by using pins or mandrels which pass through the walls of the grid and through the holes of the sorts.
Figure 14B:
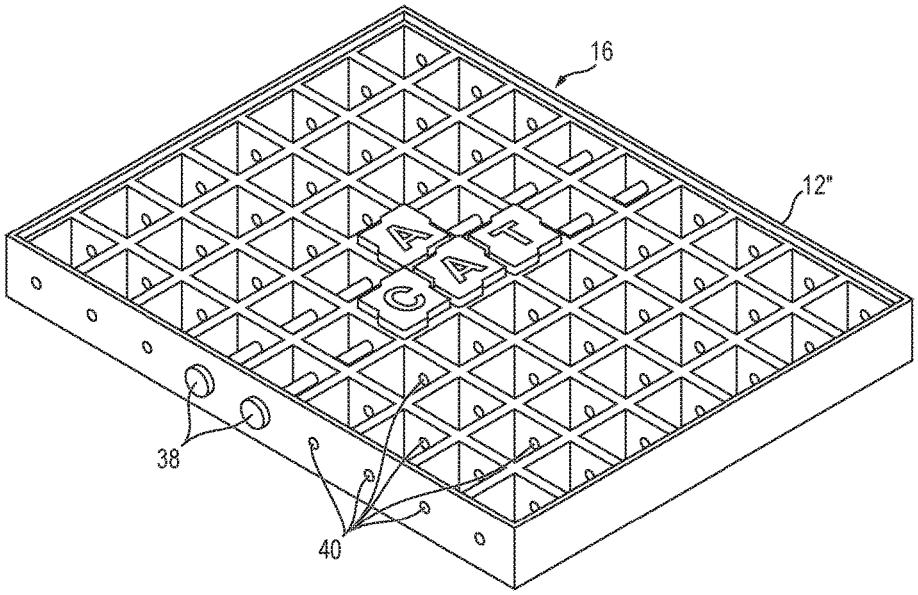
FIG. 14B illustrates the embodiment of FIG. 14A with a layout of sorts secured within a grid by the use of pins as seen and put in position by the user.

Sorts 20" are provided with tubes or conduits passing longitudinally through each sort 20". As shown in FIGS. 14A and 14B pegs or mandrels pass through exterior and interior holes 40 in grid 12". As shown in FIG. 14A the user views the mirror image of the bottom print side of the sort, making it easier to layout the sorts as desired. Once the layout is in place, pegs 38 are passed through the exterior and interior holes 40 of grid 12" as well as through the aligned conduits 36 of the sorts inserted in the grid 16". The completed layout is shown in FIG. 14B.

The pin configuration shown in FIGS. 14A and 14B makes breaking down the typeset grid setup fast, as each peg does not need to be unsnapped separately. As pin 38 is removed all of the sorts 20" associated with the pin slide out and become detached. It also creates additional space on the print side of the peg as snap features are not present, as shown in FIG. 12 and FIG. 13.

Figure 15:
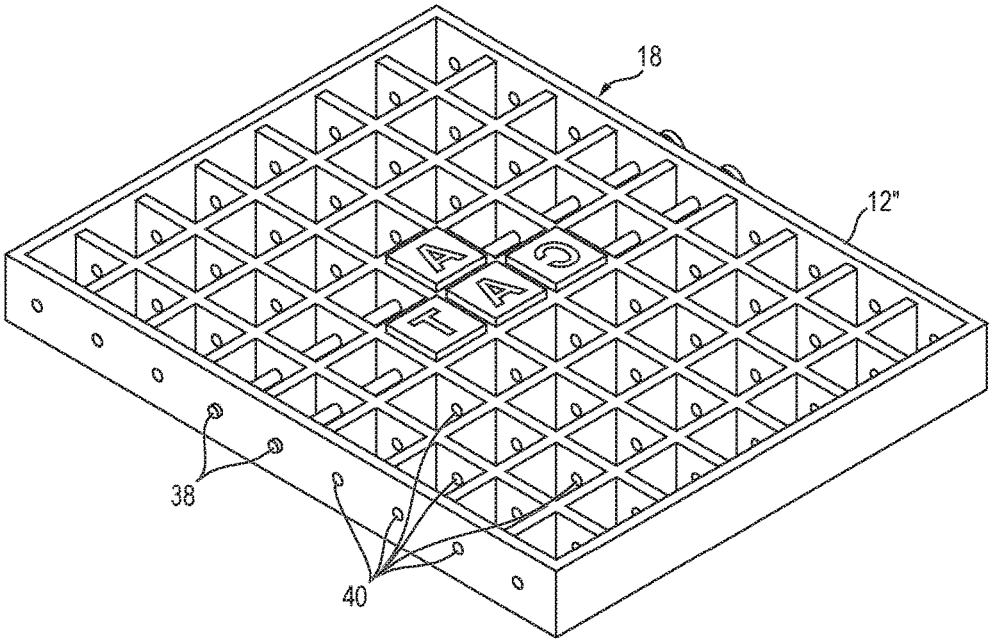
FIG. 15 illustrates the grid of FIG. 14B upside down with the sorts shown in the print position within the grid.

The open grid design and pinned pegs of this embodiment allows for the desired layout to be set and viewed as it will appear printed as shown in FIG. 14B with the reverse view necessary for printing set on the opposite side of the grid as shown in FIG. 15. This eliminates the need for the user to set the desired pattern in mirror image.

Figure 16:
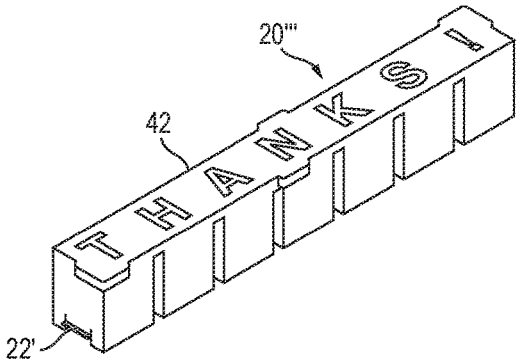
FIG. 16 illustrates a sort with a pre-set continuing pattern having dual snaps.
Figure 17:
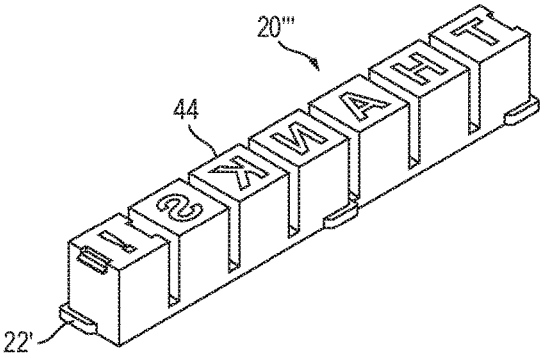
FIG. 17 illustrates the reverse side of the sort of FIG. 17, showing the print surface of the sort.

Sorts or pegs don't have to be capable of printing only a single letter, number or symbol. Pegs with a preset continuing pattern such as a design or word can be mounted in all of the embodiments described herein. Further description is provided for such sorts mounted with a dual snap feature in the same manner as described for FIGS. 1-7 above. FIG. 16 illustrates a sort 20' with a preset continuing pattern having dual snaps 22' on each end of the sort 20''' It is mounted in the grid with its top 42 illustrating to the user what the print will look like. The top 44 side of FIG. 17 illustrates the reverse side of sort 20''' shown in FIG. 16 with the mirror image of "Thanks!". This is the print side of the sort.

Figure 18:
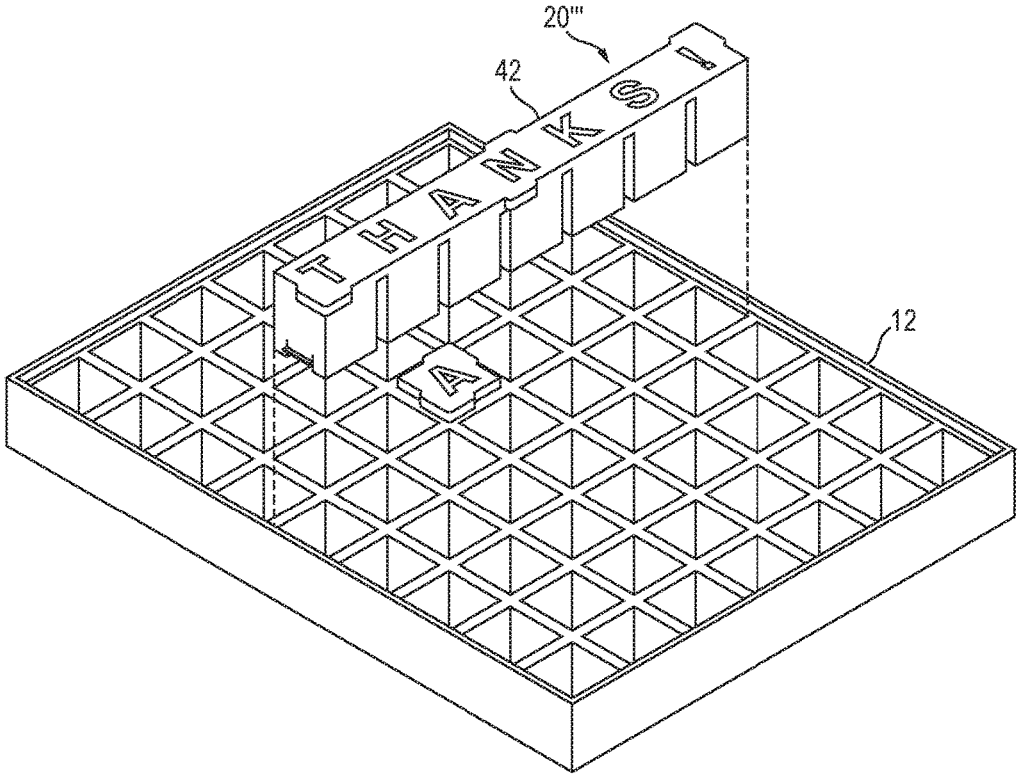
FIG. 18 illustrates how the preset sort shown in FIG. 16 is mounted within the grid.
Figure 19:
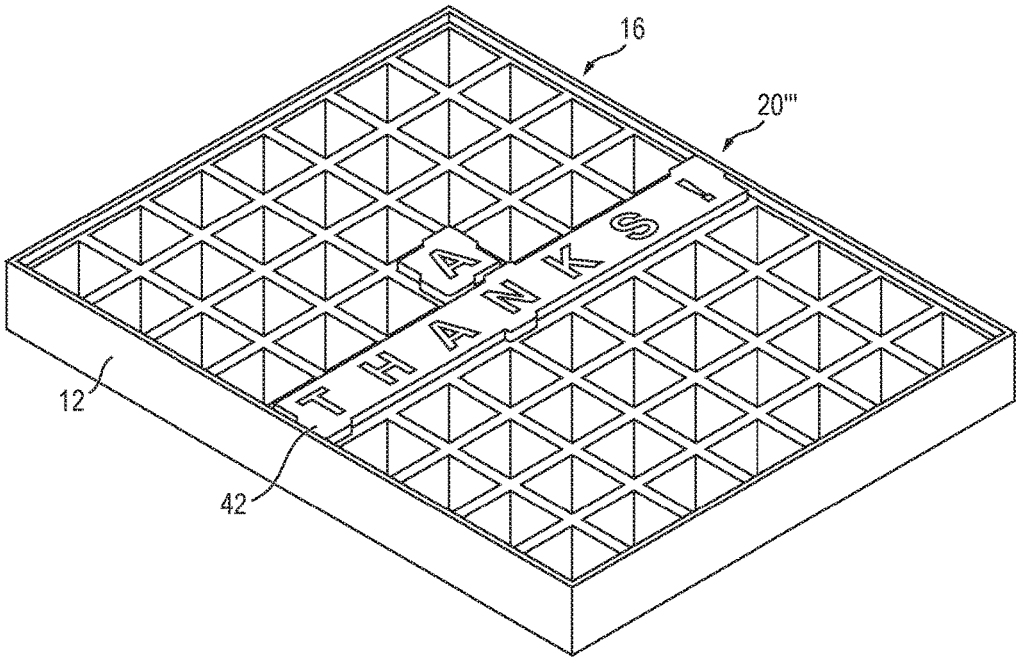
FIG. 19 illustrates how a preset continuing pattern sort allows for a simplified setup to complete the desired effect.
Figure 20:
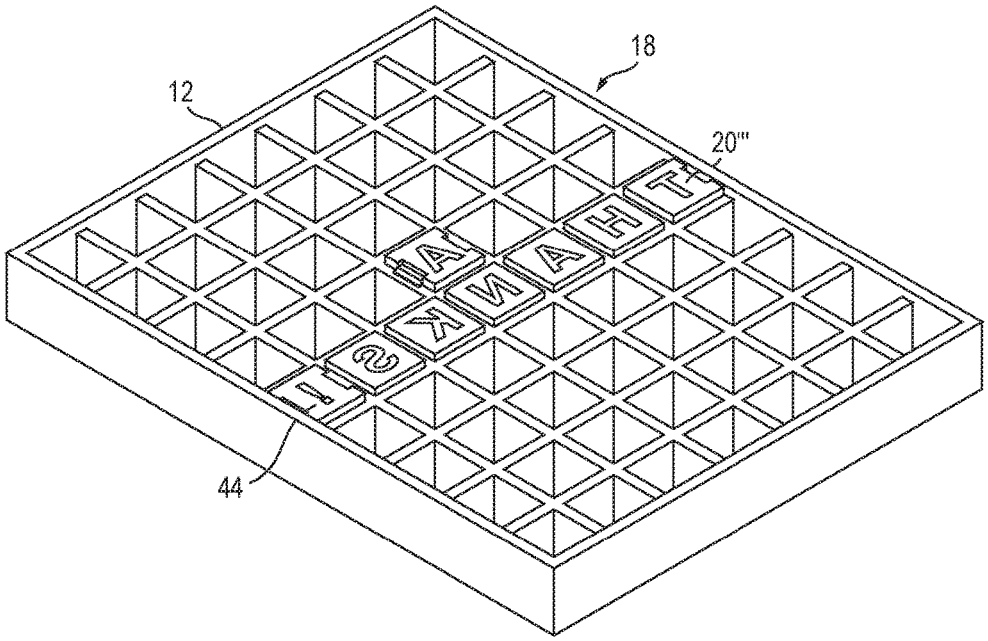
FIG. 20 shows the reverse side of the grid of FIG. 19 showing the print side of the grid.

This allows for a simplified set up to complete the desired effect as shown in FIG. 18. The layout side 42 is viewed with the inverse print image appearing on the print side 44 of the grid 12 as showed in FIGS. 19 and 20.

Figure 21:
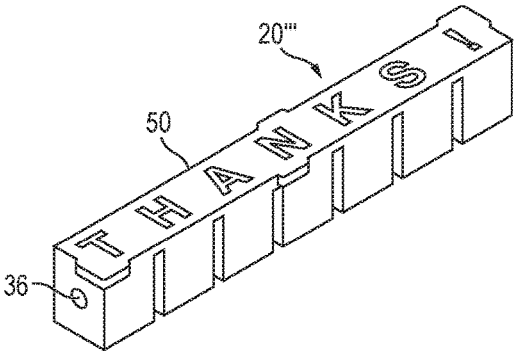
FIG. 21 shows an individual sort having a continuing pattern which extends over several grid apertures and having a hole or conduit through it.
Figure 22:
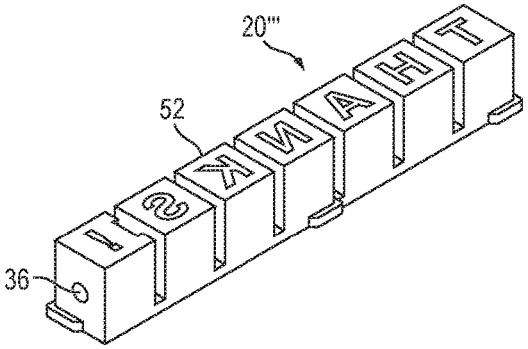
FIG. 22 illustrates the sort of FIG. 21 but inverted showing the print side of the sort.
Figure 23:
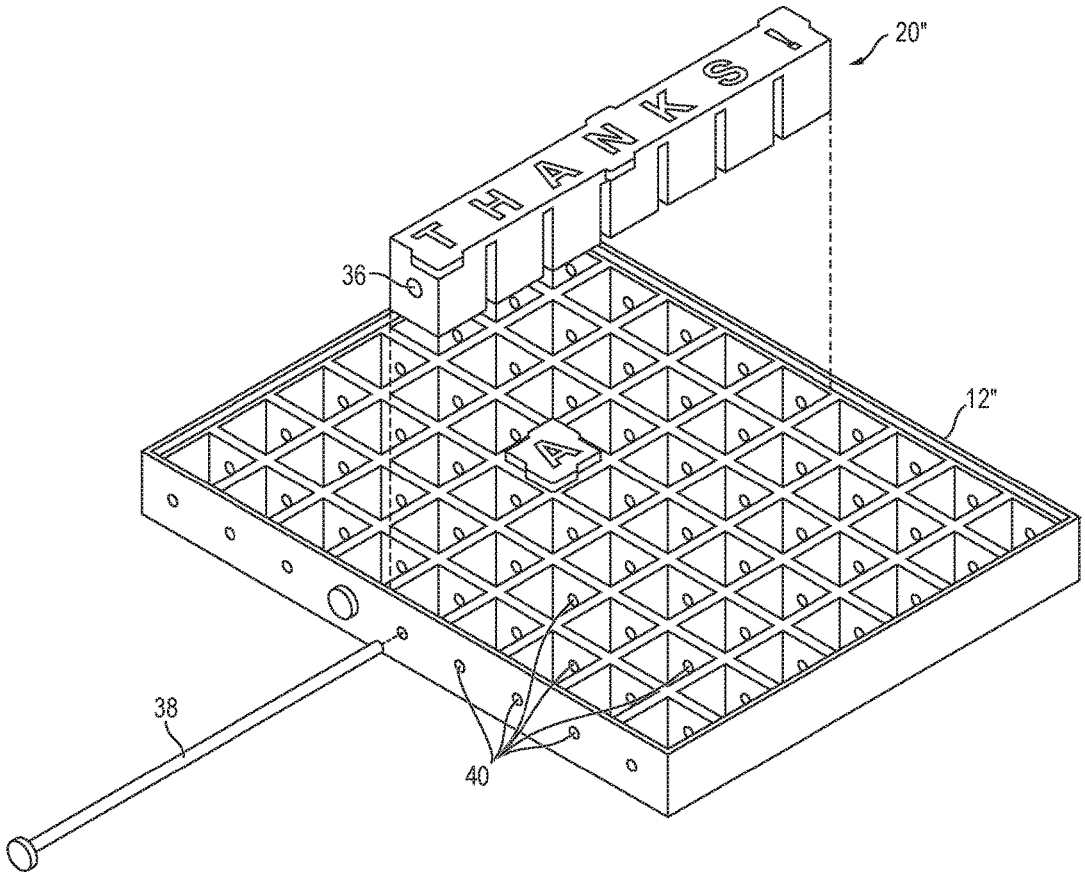
FIG. 23 illustrates another embodiment of the invention wherein a sort having the continuing pattern illustrated in FIGS. 21 and 22 is shown being secured within a grid by using pins which pass through the walls of the grid and through the conduits of the sorts.
Figure 24:
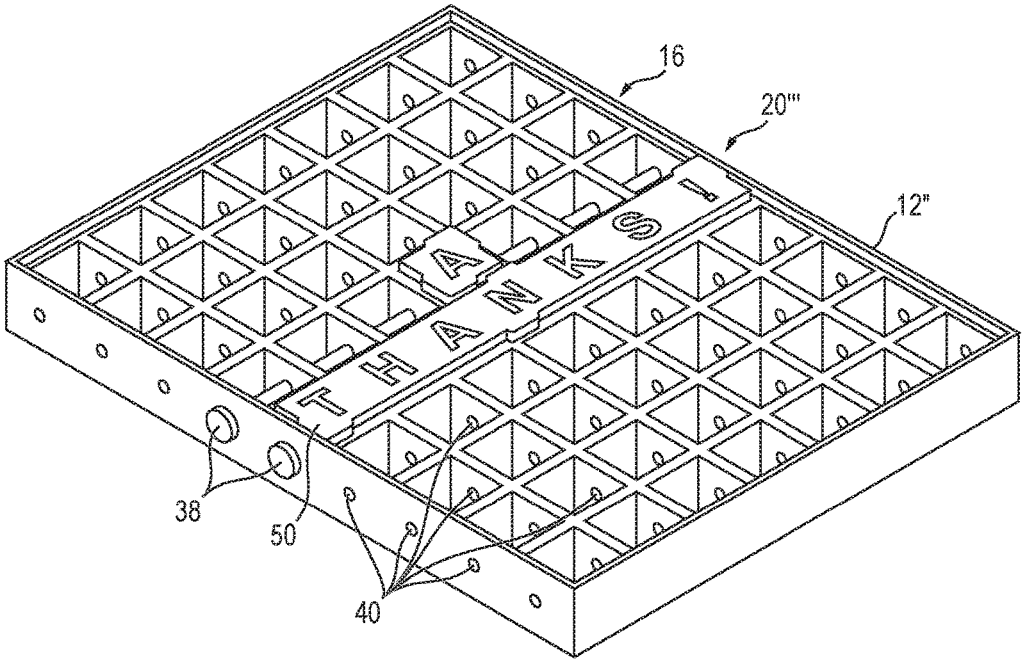
FIG. 24 illustrates the embodiment of FIG. 23 with a layout of sorts secured within a grid by the use of pins as seen and put in position by the user.
Figure 25:
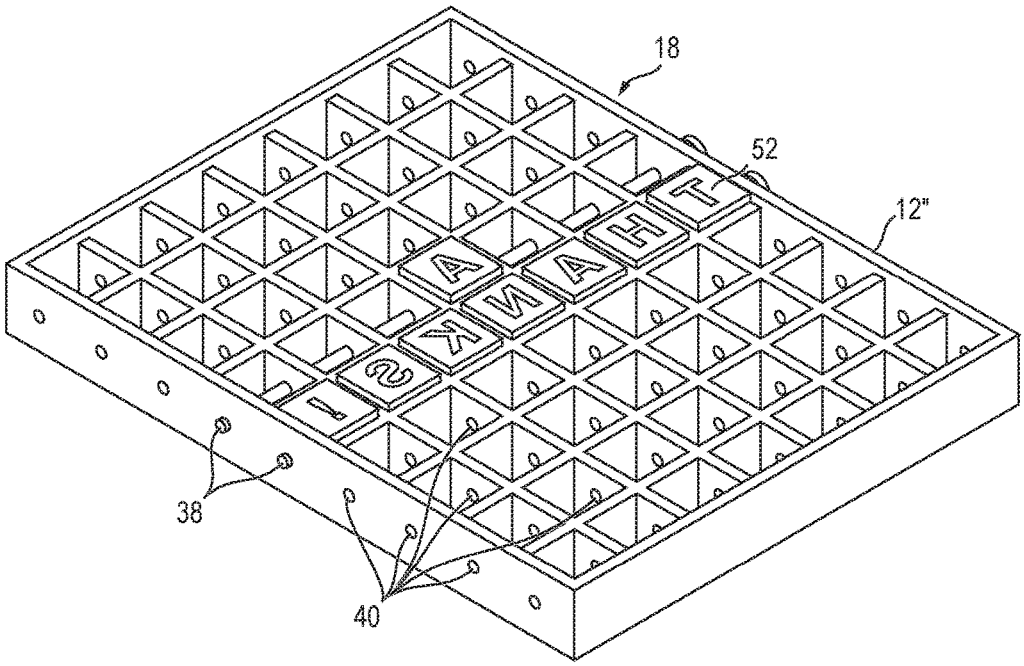
FIG. 25 illustrates the grid of FIG. 24 inverted with the sorts in the print position shown within the grid.

Referring to FIGS. 21 and 22, continuing pattern pegs 20''' are mounted with a pin feature in the same manner as described above for FIGS. 12, 13, 14A, 14B and 15. One side of the peg 50 appears to the user as the image will be printed, FIG. 21, and the other side 52 shows the inverse image for printing, FIG. 22. A pin or mandrel 38 is passed through conduits in the walls of the grid 12" and the hole in the continuing pattern peg 20", securing it into the grid, FIG. 23. The layout side of the grid is set by the user as the pattern appears in FIG. 24. The inverse image for printing is preset on the print side 52 of the grid 12" as shown in FIG. 25.

FIGS. 26-29 illustrate another embodiment of the invention. Snap pegs or sorts are mounted into the typeset grid base on standing posts. This is a simple mounting technique, although it does not allow for a two sided layout/print configuration, so text and image layout must be done in reverse.

Using a grid with male and female compatible components alignment is achieved without the need for additional spacers. Additionally, the interlocking compatibility of the male and female components secure the sorts within the desired location of the work up.

Figure 26:
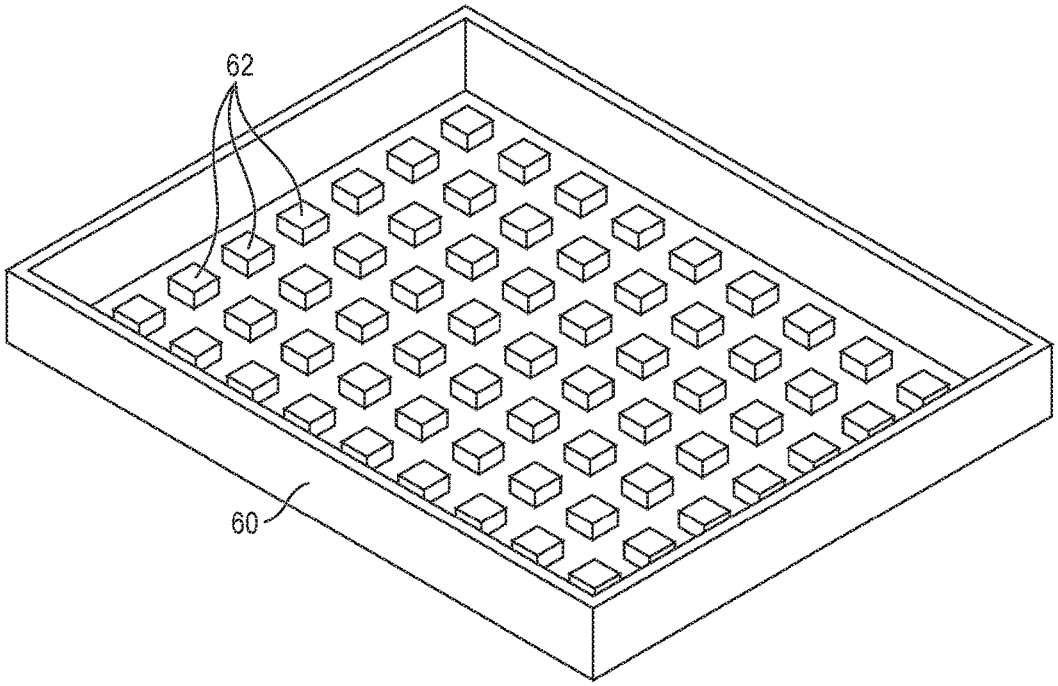
FIG. 26 illustrates another typesetting embodiment in accordance with the invention wherein sorts with female openings are snap mounted on to male snap pegs formed in a grid.
Figure 27A:
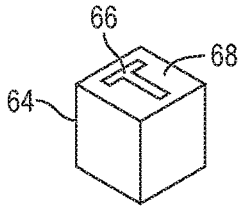
FIG. 27A illustrates a snap peg with a print image which is snap mounted into the grid of FIG. 26.
Figure 27B:
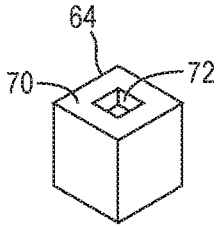
FIG. 27B shows the female opening in the reverse side of the snap peg shown in FIG. 27A.

As shown in FIG. 26, a grid base 60 is provided with a plurality of standing male posts 62 each having a generally square or rectangle cross section. Posts 62 are used to set and secure image and character pegs, snaps or sorts 64 as shown in FIGS. 27A and 27B. Snap pegs 64 have a raised image 66 for printing on one side 68 as shown in FIG. 27A. On the other side 70 of snap peg 64 is a compatible female embrasure or opening 72 as shown in FIG. 27B.

Figure 28A:
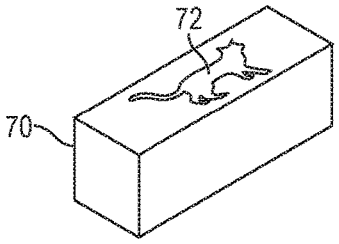
FIG. 28A shows a continuing-image snap peg for inserting in the grid of FIG. 26.
Figure 28B:
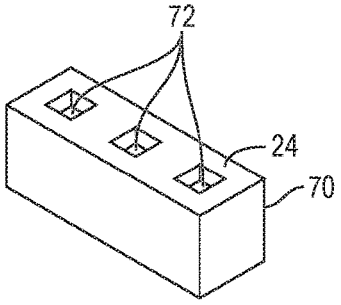
FIG. 28B shows the reverse side of the snap peg of FIG. 28A.
Figure 29:
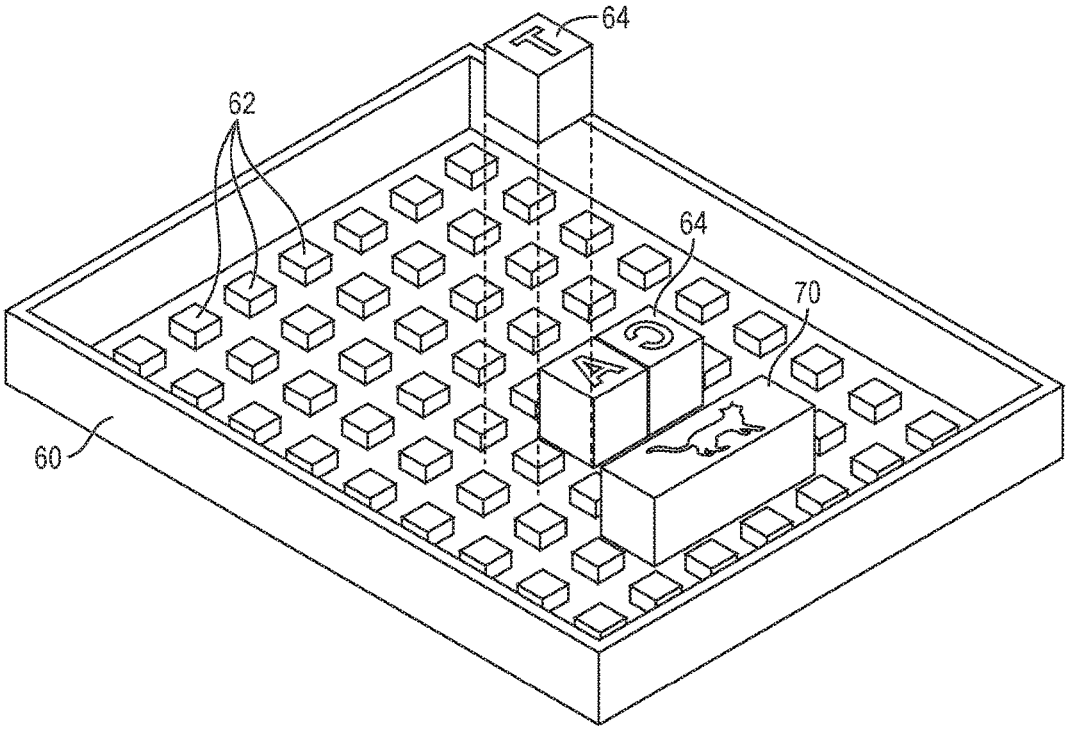
FIG. 29 shows the formatting of the grid of FIG. 26 with snap pegs.

FIG. 28A illustrates a peg 70 with a continuing pattern or image 72. FIG. 28B illustrates the opposite side 74 of peg 70 showing a plurality of female openings 72. FIG. 29 shows the layout of both single image pegs 64 and continuing pattern pegs 70 in the grid 60. The female openings 72 of each of the pegs are snap mounted within the chosen male posts 62.

Continuing pattern or image snap pegs allow for imagery to extend across male post components with one peg as shown in FIG. 29. In this embodiment fewer components and process steps are required to create a work-up. Customization and flexible use of the entire printable space are preserved.

Desired printed imagery must be set in mirror image on the grid for impression onto media as shown in FIG. 29. A grid with female openings and pegs or snaps with compatible male components can also be used.

Any device requiring consistent alignment of one or more interchangeable and arrangeable components could benefit from the grid and compatible block or peg system. This is particularly true if the components' sets are intended to be used in conjunction with a repetitive mechanical process.

It is to be understood that all of the grid and sorts of the typesetting devices described herein leave an impression which can be used for creating printed or pressed materials like stationary, clays, fabrics, or leather components. All of which can be further used to create clothing, jewelry, accessories, or other custom items. Casts to be used in other mechanical or repetitive processes can also be created.

The above disclosure is sufficient to enable one of ordinary skill in the art to practice the invention, and provides the best mode of practicing the invention presently contemplated by the inventor. While there is provided herein a full and complete disclosure of the preferred embodiments of the invention, it is not desired to limit the invention to the exact construction, dimensions, relationships, or operations as described. Various modifications, alternative constructions, changes and equivalents will readily occur to those skilled in the art and may be employed as suitable without departing from the true spirit and scope of the invention. Such changes might involve alternative materials, components, structural arrangements, sizes, shapes, forms, functions, operational features or the like. Therefore, the above description and illustration should not be considered as limiting the scope of the invention, which is defined by the appended claims.

What is claimed is:

1. A typeset apparatus which allows a user to view the image that will be printed as an image is composed comprising:

a plurality of printing sorts each having a raised portion on one side having a first image which is to be printed and having a second image on the opposite side which is a mirror image of the first image and which is viewed by the user when the image is composed;

a three dimensional grid in the form of a platen having sufficient apertures for receiving individual printing sorts to compose a complete image to be printed with all of the sorts having the first images being arranged on one side of the grid and all of the sorts having the second images being arranged on the opposite side of the grid; and an attachment device to secure the sorts within the grid for printing or embossing, the attachment device comprising a removable cover to secure the sorts within the grid once they are composed for printing.

2. The typeset apparatus of claim 1 further comprising continuing sorts which can span a plurality of the grid apertures.

3. The typeset apparatus of claim 1 wherein the attachment device cover slides and is pivoted to a first position to expose the first image to be printed.

4. The typeset apparatus of claim 3 wherein the removable attachment cover in the first position locks the sorts into place and exposes the first image to be printed.

5. The typeset apparatus of claim 4 wherein the cover slides and pivots to a second position on the opposite side of the grid from the first position and exposes the opposite side of the sorts to free the sorts after printing.

6. The typeset apparatus of claim 1 wherein the cover is transparent.

* * * * *